United States Patent [19]

Prukop et al.

[11] Patent Number: 4,972,612

[45] Date of Patent: Nov. 27, 1990

[54] FLEXIBLE HIGH HEEL INSERT WITH ARCH SUPPORT

[76] Inventors: Byron Prukop; Kathleen Prukop, both of 2273 Papaya Dr., La Habra Heights, Calif. 90631

[21] Appl. No.: 401,000

[22] Filed: Aug. 31, 1989

[51] Int. Cl.[5] ..... A43B 07/22

[52] U.S. Cl. ..... 36/91; 36/43; 128/586

[58] Field of Search ..... 36/88, 91, 71, 43, 44; 128/800, 586, 596, 610, 611, 614, 615

[56] References Cited

U.S. PATENT DOCUMENTS

| | | | |
|---|---|---|---|
| 1,646,920 | 10/1927 | Liuignano | 128/611 |
| 1,700,048 | 1/1929 | Purpura | 128/617 |
| 1,727,244 | 9/1929 | McNiff | 128/610 |
| 1,819,539 | 8/1931 | Bringardner | 128/596 |
| 2,191,210 | 2/1940 | Johnson | 128/611 |
| 2,993,405 | 7/1960 | Olson et al. | 128/614 |
| 3,265,071 | 8/1966 | Kirchner et al. | 128/586 |
| 3,835,557 | 9/1974 | Sussman . | |
| 4,130,948 | 12/1978 | Krug | 36/44 |
| 4,631,841 | 12/1986 | Hickey | 36/43 |
| 4,677,766 | 7/1987 | Gudas | 36/43 |
| 4,688,338 | 8/1987 | Brown . | |
| 4,694,590 | 9/1987 | Greennawaut | 36/71 |

FOREIGN PATENT DOCUMENTS

| | | | |
|---|---|---|---|
| 478322 | 1/1938 | United Kingdom | 36/116 |

OTHER PUBLICATIONS

Packaging from Dr. School's Super Comfort Heel Cushions.

Packaging from Dr. School's Hidden Comfort Half Insoles.

*Primary Examiner*—Steven N. Meyers

*Attorney, Agent, or Firm*—Price, Gess & Ubell

[57] ABSTRACT

A flexible high heel insert that is manufactured from a flat cushioning material. The flat cushioning material is cut so as to have a semicircular rear portion, a rectangular central portion extending at an acute angle from the rear portion, and a tapering end portion extending from the central portion. The insert generally has an adhesive back for placement in a high heel shoe. When the insert is placed in the shoe, the adhesive side of the rear portion is pressed into place in the heel area of the shoe, and the adhesive side of the tapering end portion is pressed against the inward side of the shoe so that the insert has an overall twisted configuration. The twisted configuration provides a ridge for support of a wearer's longitudinal arch and helps prevent sliding and toe pinch.

8 Claims, 2 Drawing Sheets

FLEXIBLE HIGH HEEL INSERT WITH ARCH SUPPORT

BACKGROUND OF THE INVENTION

1. Field of the Invention

This invention generally relates to cushioning and/or supportive inserts that are placed inside of shoes. More specifically, the present invention relates to a flexible insert that is specially adapted to be inserted in a high heel shoe.

2. Description of the Prior Art

At one time or another, nearly every person experiences one or more of the problems associated with uncomfortable footwear such as heel strike, lack of arch support, or pinched toes. Such discomforts typically stem from the fact that most people have feet which differ from the ideal shape and because shoes are ordinarily mass produced and therefore can only be made to accommodate the shape and structure of average feet.

Over the years, a number of prior art shoe inserts have been developed to help alleviate the above discomforts that many people experience from wearing shoes.

The above discomforts are further aggravated where the person is wearing high heel shoes because such shoes unnaturally elevate the person in the heel or calcaneus area of the foot. Notwithstanding the inherent discomfort associated with high heel shoes, many women choose to wear such shoes in order to enhance the apparent length and slenderness of their legs.

Although the prior art provides an abundant number of shoe inserts, most are unsuited for use with high heels because of slippage of the wearer's foot or the insert itself or because they occupy too much space in the limited toe area of the high heel shoe. Some inserts offer little more than odor removal.

While there are existing inserts that have been specifically designed for use with high heels, such inserts have proven to be unsatisfactory. For instance, one insert (sold under the tradename "DR. SCHOLL'S") consists only of a heel cushion and provides no arch support. Another high heel insert known to this inventor is sold by Biomechanical Composites Company under the tradename "FOOT MATES." While the "FOOT MATES" insert does provide arch support, the insert is made out of rigid graphite with a thin layer of suede and is relatively expensive. Hence, the insert offers little cushioning and in fact may itself contribute to the need for cushioning. Moreover, since the "FOOT MATES" insert is rigid, a further problem is that it must be manufactured in a variety of fixed sizes.

SUMMARY OF THE INVENTION

The present invention attempts to provide a shoe insert that addresses the above described problems associated with shoe inserts, specifically:

It is an object of the present invention to provide a shoe insert that obviates the discomfort associated with heel strike;

It is an object of the present invention to provide a shoe insert that provides adequate support for the longitudinal arch or midsection of the foot;

It is an object of the present invention to minimize slippage of the foot or of the insert within the shoe so as to prevent pinched toes; and It is an object of the present invention to provide a shoe insert that offers the above solutions at minimal cost, that does not crowd the already limited frontal toe area of the shoe, and that is easy to install in a shoe of any size.

The invention achieves the above objects by providing a flexible shoe insert comprising a substantially flat cushioning member having a longitudinal axis including: a rear portion having a substantially semicircular shape; a central portion adjacent to the rear portion, the central portion having a substantially rectangular shape and extending from the rear portion at an acute angle with respect to the longitudinal axis; and a tapering end portion adjacent to and extending from the central portion opposite the rear portion, the tapering end portion tapering towards a point along its width.

The features of the present invention which are believed to be novel are set forth with particularity in the appended claims. The present invention, both as to its construction and manner of operation, together with further objects and advantages thereof, may best be understood with reference to the following description, taken in conjunction with the accompanying drawings.

DETAILED DESCRIPTION OF THE PREFERRED EMBODIMENT

The following description is provided to enable any person skilled in the art of shoe inserts to make and use the invention and sets forth the best mode contemplated by the inventor for carrying out the invention. However, various modifications will remain readily apparent to those skilled in these arts, since the generic principles of the present invention have been defined herein specifically to provide a relatively economical and practical cushioning insert for use with high heel shoes and shoes in general.

Figure 1:
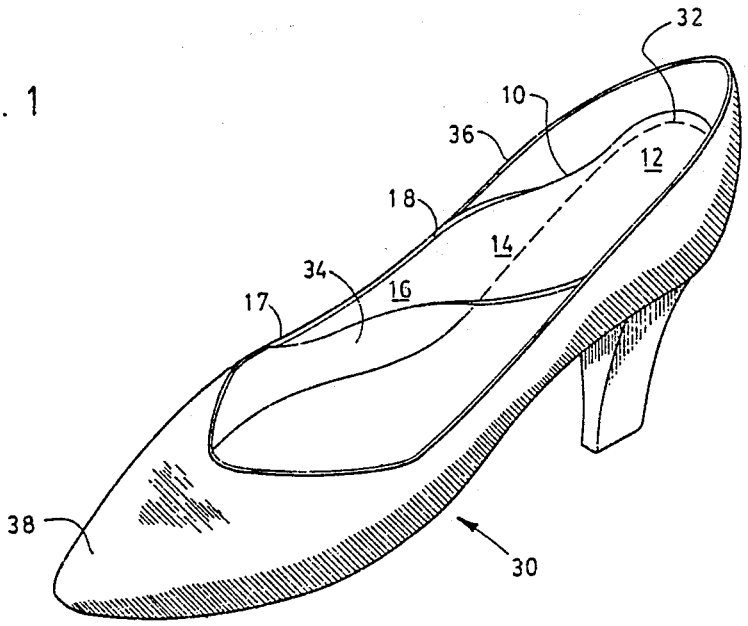
FIG. 1 is a perspective view of a preferred insert according to the present invention shown as inserted into a woman's left high heel shoe.

FIG. 1 is a perspective view of a lady's left high heel shoe 30 with a preferred embodiment of a left insert 10 according to the present invention installed therein.

Figure 2:
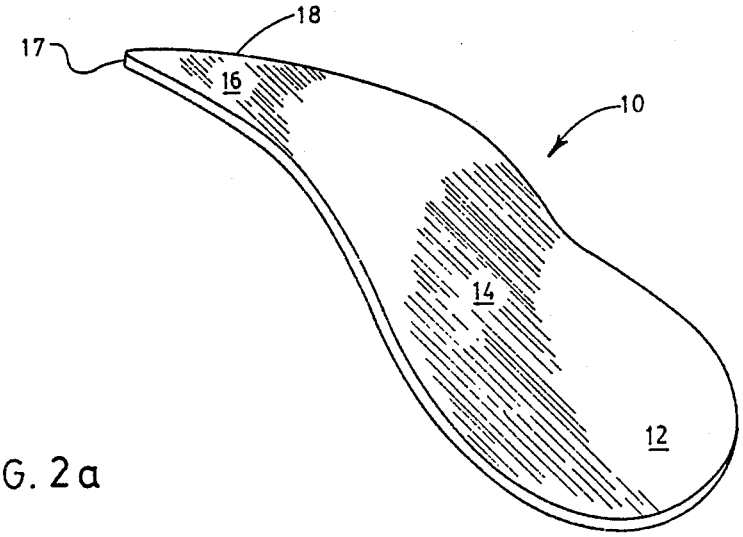
FIG. 2 is a perspective stand-alone view of the preferred insert illustrated in FIG. 1.
Figure 4:
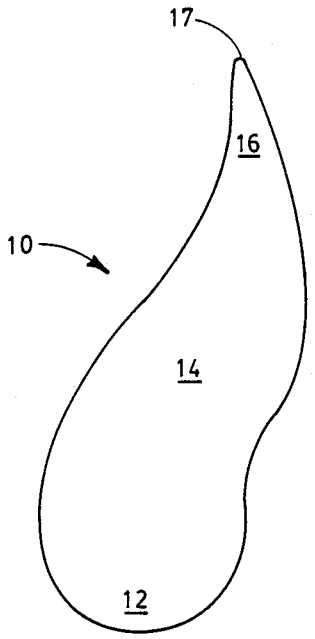
FIG. 4 is an upper plan view of a preferred insert for use with a left shoe.
Figure 5:
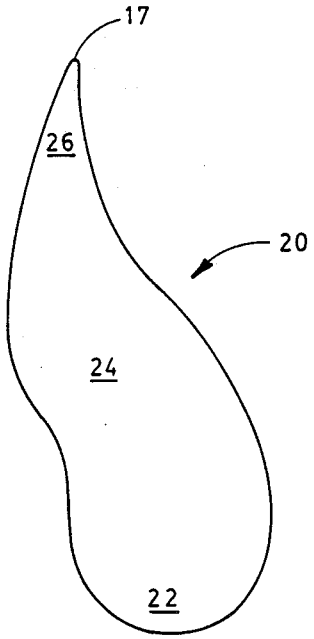
FIG. 5 is an upper plan view of a preferred insert for use with a right shoe.

As illustrated by FIGS. 2, 4, and 5, an insert 10, 20 is comprised of three main areas: a rear portion 12, 22 having a substantially semicircular shape, a central portion 14, 24 having a substantially rectangular shape and extending from the rear portion 12, 22 at an acute angle, and a end portion 16, 26 which end portion 16, 26 tapers towards a point 17, 27. The insert may taper to an actual point or instead only taper towards a point and thereby have an end of a predetermined radius or other perimeter shape. As best shown by FIGS. 4 and 5, the left shoe insert 10 is a mirror image of the right shoe insert 20.

The preferred material for construction of the insert 10, 20 of the present invention is a $\frac{1}{4}''$ piece of foam. Such material should have sufficient cushioning and resiliency properties while also providing a non-slip surface. An example of such a material is a cross-linked polyolefin foam sold under the tradename "TROCELLEN" by Dynamit Nobel of America Inc. The foam material is simply cut into the appropriate shapes as shown in FIGS. 4 and 5. Cushioning inserts made in accordance with the present invention need only be made in one or two sizes because the foam material can be easily trimmed to size by the end purchaser. TROCELLEN is also desirable because it offers an underlying foam material with an outer absorption layer that operates to keep the wearer's foot dry.

In the preferred embodiment, the foam inserts 10 and 20 further include a peel-off adhesive back for simple and firm installation in the shoe 30.

Figure 2A:
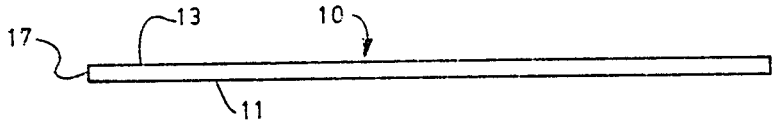
FIG. 2*a* is a elevational side view of the preferred insert illustrated in FIG. 2.

The actual installation of the inserts will now be explained with reference to FIGS. 1, 2, and 2*a*. The insert 10, has a top side 13 and an under side 11 where the underside 11 includes a peel-off adhesive surface. The peel-off backing is not shown in FIG. 2*a* as such an arrangement s well known in the art and the backing itself does not form an integral part of the present invention. Once the adhesive backing on the under side 11 is expose by peeling off the protective covering, the shoe insert 10 is placed into the shoe 30. The rear section 12 is initially pressed into place in the heel area 32 of the shoe 30. Next, the insert 10 is twisted such that the under side 11 of the insert 10 near the end portion 16 faces the inner side 34 of the shoe 30. At this point, the user would press or rub the top side 13 of the insert in order to achieve a firm adhesion between the shoe 30 and the under side 11 of the insert 10 having an adhesive backing.

An insert 10 installed in this fashion will result in a ridge that will help support the longitudinal arch of the user. As can be seen in both FIGS. 1 and 3, when the insert 10 is properly installed in the shoe 30, the insert 10 has a slightly twisted configuration running from the rear portion 12 through the central portion 14 to the end portion 16. This twisted configuration beneficially causes the central portion to form a ridge that gently supports the longitudinal arch 35 on the underside of the user's foot. Moreover, this twisted configuration, by taking the end portion to the side 34 and out of the way, achieves such arch support without placing any additional material in the toe area 38 of the shoe. This latter feature, in combination with the frictional contact between the top side 13 of the support ridge and the wearer's foot 40, combine to help prevent sliding of the wearer's foot and pinching of the wearer's toes 42.

Figure 3:
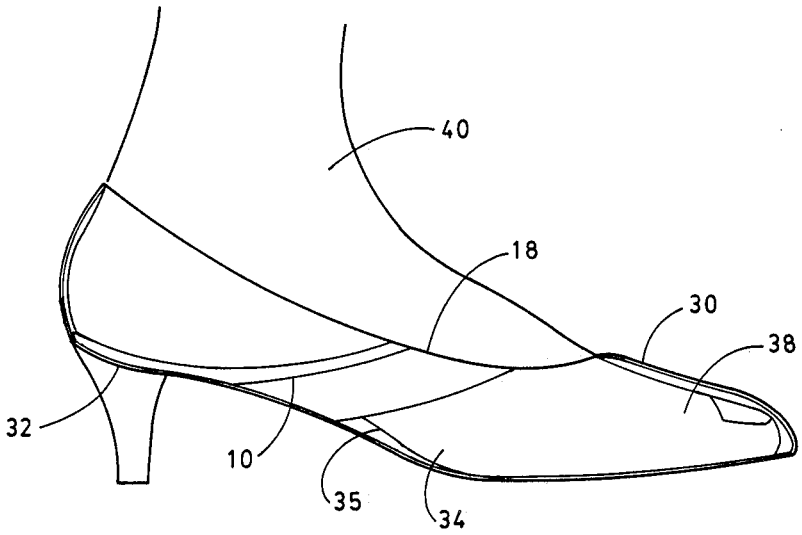
FIG. 3 is a see-through side view of showing the preferred insert in use with a user's foot in a high heel shoe.

A particular benefit of this invention is that during installation the user can adjust the height and placement of the ridge formed by the twisted insert. The user may adjust the support ridge by varying the placement of the end portion 16 on the inner wall 34 of the shoe 10. In FIGS. 1 and 3, the edge 18 of the end portion 16 is shown flush with the top 34 of the side wall 34 of the shoe 30. However, the edge 18, at the user's discretion, could be placed at various positions below the top 34 of the shoe.

It is contemplated that a shoe insert 10 according to the present invention would be manufactured and sold in two sizes: a first size (petite) to accommodate shoe sizes in the approximate range of 5 to 7 and a second size (regular) to accommodate shoe sizes from approximate range of 7½ to 10. In either event, where the edge 18 of the end portion 16 protrudes above the top 36 of the inner wall 34, the user would simply trim the protruding portion with an ordinary pair of scissors. By trimming the edge 18, the user may achieve a perfect fit where edge 18 is flush with the top 36 of the side wall 34.

As discussed earlier, TROCELLEN is the preferred material for construction of the insert 10. A further beneficial characteristic of a material like TROCELLEN is that it is relatively compressible along its edges so that the wearer will not be overly aware of the downward edge 19 of the insert 10. Alternatively, the insert 10, 20 could diminish in width from the rear portion 12, 22 towards edge 19 in order to substantially meld the insert with the inner surface of shoe 30.

While the above features of the present invention teach the construction, configuration and application for an improved shoe insert, it can be readily appreciated that it would be possible to deviate from the above embodiments of the present invention and, as will be readily understood by those skilled in the art, the invention is capable of many modifications and improvements within the scope thereof. Accordingly, it will be understood that the invention is not limited by the specific embodiments but only by the spirit and scope of the appended claims.

What I claim is:

1. In combination with a shoe having an inside wall, a heel area, and a longitudinal arch area, a substantially flat flexible shoe insert having an underside, a topside, and a longitudinal axis that is parallel to the longitudinal axis of the shoe, the insert comprising:

a rear portion at one end of the longitudinal axis, the rear portion being shaped so that the underside of the rear portion substantially overlays the heel area of the shoe;

a tapering end portion at the other end of the longitudinal axis, the width of the insert tapering towards a point along its width from the rear portion to the tapering end portion; and a central portion located between the rear portion and the tapering end portion, the underside of the tapering end portion being adapted to engage the inside wall of the shoe, the insert thereby having a twisted configuration along the longitudinal axis from the rear portion to the end portion when the insert is inserted in the shoe such that the rear portion is positioned to provide additional cushion in the heel area of the shoe, the central portion is positioned to provide a cushioning ridge in the longitudinal arch area of the shoe, and the tapering end portion is positioned against the inside wall of the shoe.

2. The flexible shoe insert of claim 1 wherein the flexible shoe insert is comprised of a foam material.

3. THe flexible shoe insert of claim 2 wherein the foam material is TROCELLEN.

4. The flexible shoe insert of claim 1 wherein the insert further comprises an adhesive backing on the underside of the insert for engagement with the shoe.

5. A method of providing arch support in a shoe comprising the steps of (a) placing a rear portion of a flexible shoe insert against the heel area of the shoe; (b) twisting the flexible shoe insert along a central portion so as to form an arch support ridge; and (c) placing an end portion of the flexible shoe insert against an inside wall of the shoe, the flexible shoe insert comprising;

a rear portion having a substantially semicircular shape;

a central portion adjacent to the rear portion, the central portion having a substantially rectangular shape and extending from the rear portion at an acute angle with respect to the longitudinal axis; and a tapering end portion adjacent to and extending from the central portion opposite the rear portion, the tapering end portion tapering towards a point along its width.

6. The method of claim 5 wherein one side of the flexible shoe insert includes an adhesive backing.

7. The flexible insert of claim 5 wherein the flexible shoe insert is comprised of a foam material.

8. The flexible insert of claim 7 wherein the foam material is TROCELLEN.

* * * * *

UNITED STATES PATENT OFFICE

CERTIFICATE OF CORRECTION

Patent No. 4,972,612 Dated Nov. 27, 1990

Inventor(s) Albert Byron Prukop; Caryl Kathleen Prukop

It is certified that error appears in the above-identified patent and that said Letters Patent is hereby corrected as shown below:

On the title page of the above patent, under

[76] Inventors: delete "Byron Prukop; Kathleen Prukop,"

and insert --Albert Byron Prukop; Caryl Kathleen Prukop,--.

Signed and Sealed this

Sixteenth Day of June, 1992

*Attest:*

DOUGLAS B. COMER

*Attesting Officer*

*Acting Commissioner of Patents and Trademarks*